US005802623A

United States Patent [19]

Vincent

[11] Patent Number: 5,802,623

[45] Date of Patent: Sep. 8, 1998

[54] ELECTRONIC AIR DEODORIZER AND METHOD OF USING SAME

[76] Inventor: Ray T. Vincent, 3425 S. 176th St., Suite 136, Seattle, Wash. 98188

[21] Appl. No.: 567,901

[22] Filed: Dec. 6, 1995

[51] Int. Cl.[6] ..... E03D 9/04

[52] U.S. Cl. ..... 4/209 R; 4/213; 431/5

[58] Field of Search ..... 4/209 R, 211, 4/213, 216, 217, 219, 221; 431/264, 265, 266, 354, 5

[56] References Cited

U.S. PATENT DOCUMENTS

| | | | |
|---|---|---|---|
| 3,579,650 | 5/1971 | Sloan . | |
| 3,719,471 | 3/1973 | Jones | 431/5 |
| 3,860,972 | 1/1975 | Costello | 4/353 |
| 3,914,088 | 10/1975 | Huyck | 431/5 |
| 3,993,429 | 11/1976 | Archer | 431/5 |
| 4,200,940 | 5/1980 | Buchanan . | |
| 4,610,622 | 9/1986 | Quinnell | 431/5 |
| 4,800,596 | 1/1989 | Menge . | |
| 4,826,427 | 5/1989 | Hyde | 431/264 |
| 4,900,244 | 2/1990 | Keller et al. | 431/5 |
| 4,999,998 | 3/1991 | Akerib . | |
| 5,029,346 | 7/1991 | Fernald, Sr. . | |
| 5,141,529 | 8/1992 | Oakley et al. . | |
| 5,210,884 | 5/1993 | Redford . | |
| 5,288,305 | 2/1994 | Gellert et al. . | |
| 5,302,190 | 4/1994 | Williams . | |
| 5,310,334 | 5/1994 | Spiros | 431/5 |
| 5,332,562 | 7/1994 | Kersey et al. . | |
| 5,361,422 | 11/1994 | Vincent . | |
| 5,460,511 | 10/1995 | Grahn | 431/5 |
| 5,498,154 | 3/1996 | Velie et al. | 431/264 |

*Primary Examiner*—Henry J. Recla
*Assistant Examiner*—Charles R. Eloshway
*Attorney, Agent, or Firm*—Fulwider Patton Lee & Utecht, LLP

[57] ABSTRACT

An electronic air oxidizer deodorizing system includes an air conduit including inlet and outlet ends. The air conduit houses therein a zapper comprising a pair of spaced apart highly charged electrodes which create an electrical discharge therebetween. A blower is also provided for drawing air through the inlet end and past the electrodes.

7 Claims, 3 Drawing Sheets

ELECTRONIC AIR DEODORIZER AND METHOD OF USING SAME

BACKGROUND OF THE INVENTION

1. Field of the Invention

The present invention relates to systems for eliminating odorous gases from toilets, kitchens or other enclosed spaces and, more particularly, to an apparatus which employs an electrical discharge to burn odorous gases and to incinerate air-borne bacteria.

2. Description of the Prior Art

Many different devices have been proposed in effort to neutralize offensive odors typically associated with certain activities such as human use of a toilet and cooking. It has long been recognized that conventional toilets have no effective mechanism for efficiently eliminating or disposing of the noxious gases resulting from a user's bowel movement or the associated escape of gas. This can prove to be a considerable embarrassment in relatively confined spaces, such as in a residential toilet, or in a public restroom which is in continuous use, due to the fact that the offensive odors may remain therein for quite some time.

Prior efforts to resolve this problem associated with offensive bathroom odors have led to the proposal that chemical disinfectants be placed in the water tank or in the toilet bowl itself. However, chemical disinfectants merely serve to mask such odors, rather than actually eliminating them. In addition, due to growing environmental concerns, an increasing number of restrictions have been placed on the use of chemicals which may be eventually dumped into a water disposal system.

Another common method employed in an effort to deodorize a bathroom involves mounting an exhaust fan in the ceiling of the bathroom to draw air from the bathroom to be conducted through an air passage to be discharged through a remote exhaust outlet. To achieve any degree of effectiveness, such a method requires that a large volume of air be removed from the bathroom to carry the odorous gases dispersed therein away thus necessitating the operation of high volume blowers which often generate distinctive noises and serve to remove heat along with the air flow. In addition, such systems are generally ineffective to efficiently remove the offensive gases within any reasonable amount of time, such as before the bathroom is to be again occupied by a user.

Venting systems have been proposed to be connected directly to a toilet to withdraw gases from the confines of the toilet bowl to be discharged through some remote outlet external to the building. Different embodiments of such a device are shown in U.S. Pat. No. 5,029,346 to Fernald, U.S. Pat. No. 4,800,596 to Menge, and U.S. Pat. No. 3,579,650 to Sloan. Such devices suffer the same shortcoming as does a ceiling mounted fan, namely that the odorous gases are not effectively eliminated, but are merely diluted by the inrush of replacement air. In addition, a somewhat elaborate conduit system may be required in order to conduct such gases from the bathroom to a location external to the building, especially in a large apartment complex or the like.

Yet another venting system, co-invented by and assigned to the inventor of the present invention, is disclosed in U.S. Pat. No. 5,361,422. While satisfactory generally, that system does not actually treat the noxious gases to change their chemical composition.

Another device proposed for withdrawing odorous gases from a toilet includes a blower mounted within a toilet bowl to create air circulation inside the bowl. A bowl skirt is fitted on a conventional toilet seat to cooperate with the blower to create a cyclone-type air circulation within the bowl. Centrifugal air currents serve to drive the odorous gases to the periphery of the toilet bowl and into an air trapping cavity defined beneath the bowl-skirt. Such gas remains trapped until the suction effect created during a toilet flush purges the gases into the sewer line. Such a device is shown in U.S. Pat. No. 5,210,884 to Redford. This device also suffers the shortcoming that it does not destroy odorous gases, but rather acts to transport them from the toilet.

Yet another device designed for disposing of odorous gases associated with human use of a toilet includes an incinerating device connected to one end of an air hose connected at its opposite end to openings formed on the radially inwardly facing surface of a hollow toilet seat. A fan is provided to draw air through the openings and air hose into the device where the air is directed through a grid device formed of tungsten wires and connected to a source of electricity. Thus as the air passes through the grid, it purportedly will be heated sufficiently to cause the odorous, volatile gases to burn to create by-products which do not have an offensive smell. This device is not free from shortcomings, however. Ignition temperatures for such offensive gases range from approximately 450 to 1300 degrees Fahrenheit. Thus the grid must create very high temperatures in order to ignite such gases. This requires a significant amount of energy and is costly to operate because it heats not only the target gases but also the more voluminous air passing through the grid. In addition to the attendant fire hazard, the substantial internal temperatures created by the device could, in the event of extensive use, result in the bathroom itself being heated to elevated temperatures, thus adding to the load placed on any air conditioner and, in some instances, creating a risk of severely injuring a user who comes in close proximity with the high temperature element.

As such, it will be appreciated that there continues to be a need for a device which will eliminate odorous gases in the air found in relatively enclosed spaces such as gases associated with human use of a toilet in a cost efficient and safe manner. The instant invention addresses such needs.

SUMMARY OF THE INVENTION

Briefly, and in general terms, the present invention includes an open ended air conduit defining a flow path and housing therein a zapper comprising a pair of spaced apart electrodes connected to a spark generator powered by an external power source. One electrode is grounded and the other is electrically charged by the spark generator such that the voltage difference between the electrodes causes an electrical discharge in the form of a spark to pass from the charged to the grounded electrode. A blower is also connected to the gas conduit to draw air through the air conduit in intimate contact with the electrodes of the zapper.

The apparatus of the present invention may also include an electronic dust precipitator to be electrically charged by the spark generator to capture ions created during the electrical discharge across the electrodes. In addition, a housing may be provided and formed with a raised collection dome to collect hot gases ignited by the electrodes. The collection dome connects with an air pump which serves to conduct the gas in the dome through a tube and to an external source such as into a toilet water tank.

DETAILED DESCRIPTION OF THE PREFERRED EMBODIMENT

Figure 1:
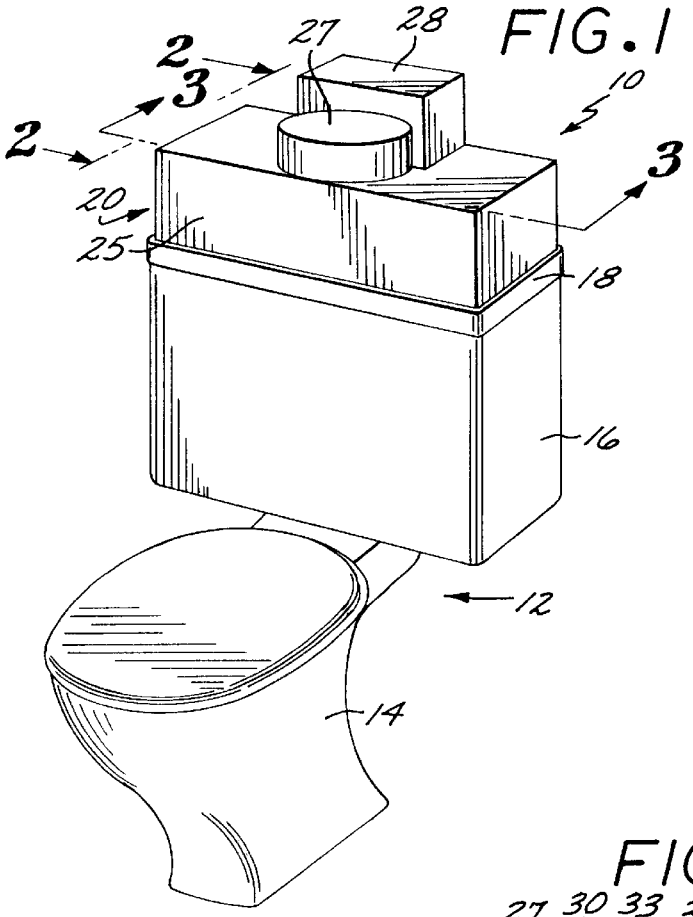
FIG. 1 is perspective view of a toilet including an electronic air deodorizer system embodying the present invention.
Figure 5:
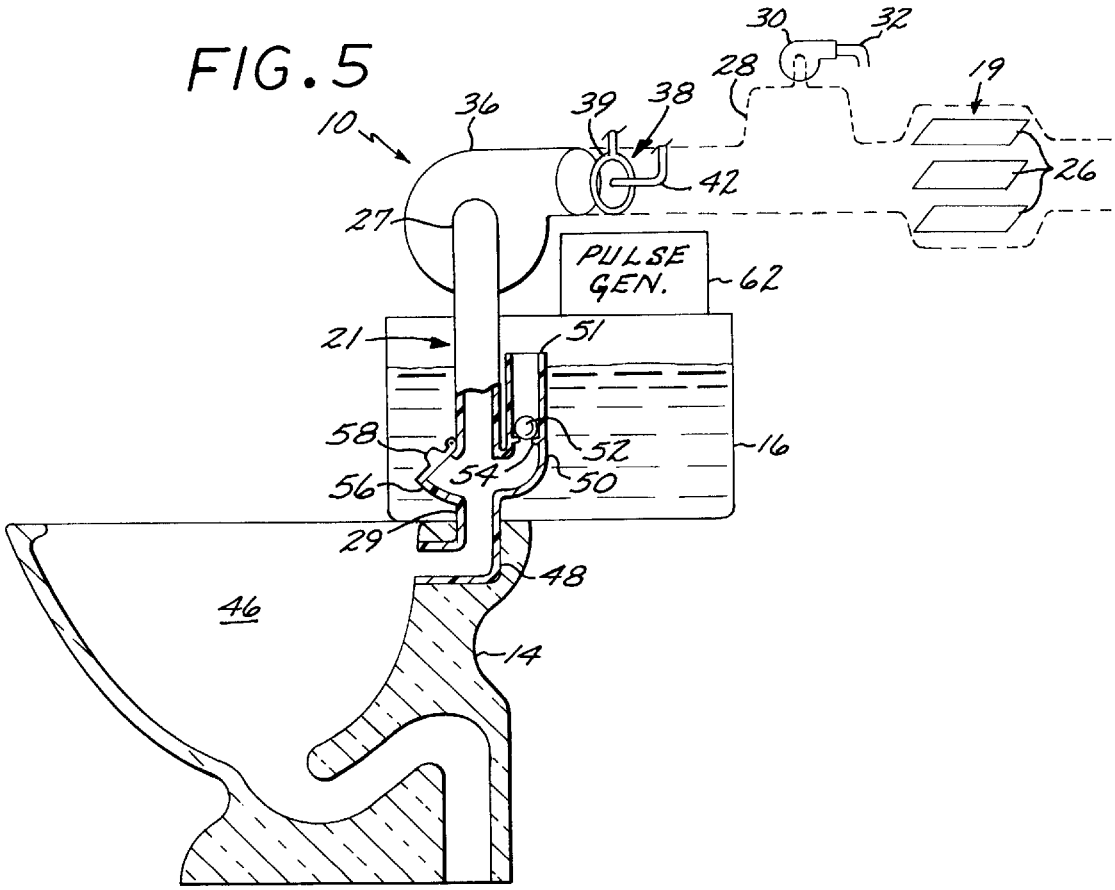
FIG. 5 is a partially sectioned schematic diagram of the gas deodorizer system shown in FIG. 1.

In the following detailed description, like reference numerals will be used to refer to like or corresponding elements in the different figures of the drawings. Referring now to the drawings, and particularly to FIGS. 1, 3 and 5, there is shown generally an air deodorizer system 10 of the present invention in one application thereof connected to a conventional toilet 12. As described in greater detail below, the air deodorizer system of the present invention will have many beneficial uses, only one of which is associated with a toilet. Thus, the system is shown in the figures and described herein in connection with a toilet, but it will be appreciated that the system could be utilized in many different situations and locations. In a preferred embodiment, the air deodorizer system comprises, generally, a housing 20 formed in its bottom wall with an opening 23 through which extends an air conduit, generally designated 21. The air conduit connects at its lower end with a gas outlet 48 leading from a toilet bowl 46 (FIG. 5). The upper end of the air conduit connects with a blower 36 housed in the housing and driven by a motor 34 to draw air from the toilet bowl through the outlet and upwardly through the air conduit. Connected to the outlet of the blower is a zapper, generally designated 38, comprising a pair of spaced apart electrodes 39 and 42 which are electrically charged by a spark generator 62 comprising a transformer 24 and pulse generator 44 to produce an electrical discharge to be conducted between the electrodes. Mounted on the housing is a collection dome 28 which has housed therein an air pump 30. The air pump feeds a scrubber tube 32 which includes a distal end disposed within the toilet tank 16. The housing further houses therein an electronic dust precipitator, generally designated 19, which acts to collect charged particles before the deodorized air is discharged from the housing through a plurality of exhaust ports 22 (FIG. 2).

Human use of a toilet often results in the creation of unpleasant odors within the bathroom. Solid body waste discharged during defecation typically includes indole, skatole, hydrogen sulfide and mercaptans. Indole and skatole are responsible for what is characterized as fecal odor, while mercaptans have an unpleasant garlic-type odor. Hydrogen sulfide is responsible for the characteristic odor of rotten eggs. In addition, flatus or intestinal gas is often discharged by the human body during defecation. Flatus typically comprises a majority of hydrogen sulfide and some methane.

The above compounds share one common characteristic: they are all flammable. Thus, the various offensive odors associated therewith can be eliminated by burning such compounds. Because nitrogen does not support combustion, the oxygen molecules in the air must be sought out and heated to burn such compounds. Because the disruption strength of oxygen is less than that of nitrogen, an electrical spark may be utilized to seek out the oxygen atoms in the air and pass therethrough to raise the temperature of such atoms to the order of several thousand degrees Fahrenheit. The heated oxygen atoms will act to ignite the above-mentioned compounds which are in close proximity thereto, thereby resulting in such compounds being burned to form non-odorous compounds. The present invention provides a device which conveniently utilizes electrical discharge to ignite and thereby burn such odorous compounds to eliminate the odors associated with such compounds. In addition, the electrical discharge will also serve to incinerate air-borne virus and bacteria due to the lower electrical resistance of virus and bacteria relative to air.

Figure 2:
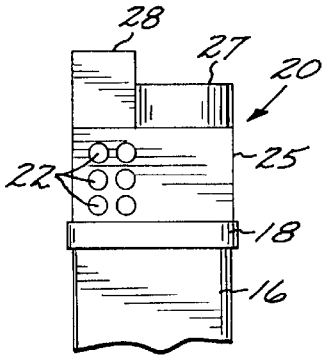
FIG. 2 is a fragmented sectional view taken along the line 2—2 of FIG. 1.
Figure 3:
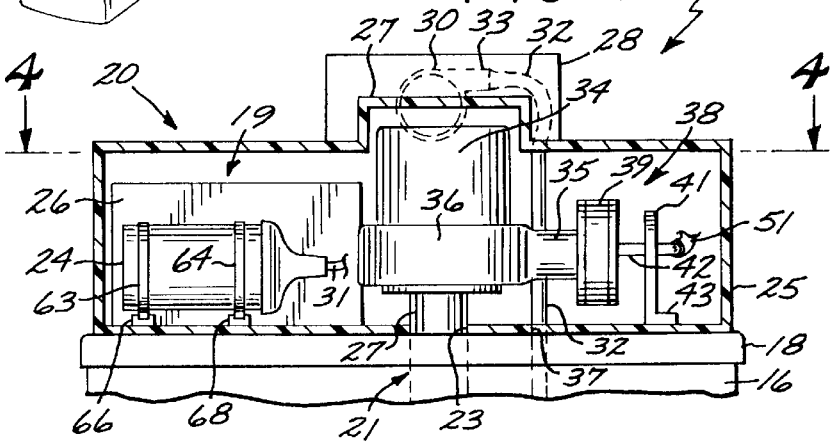
FIG. 3 is a vertical sectional view, in enlarged scale, taken along the line 3—3.

The housing 20 is in the form of a generally rectangular box 25 formed in its upper end wall with a forwardly disposed, central circular opening and rearwardly with a centrally disposed rectangular opening to mount, respectively, a cylindrical, downwardly opening shell 27 and the collection dome 28 (FIGS. 1 and 2). Such box is formed in top plan view with dimensions substantially equivalent to those of the top plan view of a conventional toilet tank lid 18 for resting thereon in a convenient, out-of-the-way manner. Formed in one of the longitudinal end walls of the casing are a plurality of spaced apart air exhaust ports 22 (FIG. 2) for exhaust of clean air from the housing as described in greater detail below.

The air conduit 21 includes a first end 27 which projects upwardly through the opening 23 formed in the lower end of the housing 20 to connect with the inlet of the blower 36 (FIG. 3). The lower end 29 of the conduit may be externally threaded (not shown) for engagement with the air outlet 48. As such, the air conduit defines an air flow path from the air outlet into the housing 20. The air conduit further includes a pair of oppositely disposed ports formed in the side walls thereof (FIG. 5). One of such ports connects to a flush valve 58. The flush valve is connected to a flush control mechanism (not shown) and is manipulated by same to pivot upwardly thus exposing the port and allowing the flow of water downwardly through the conduit 21 and into the toilet bowl 46 during a flush of the toilet. The other such port carries an upstanding overflow air line 50 terminating in an open second end 51 disposed above the normal waterline in the toilet tank 16. The water overflow line houses therein a ball check valve comprising a ball 52 resting on an annular seat 54. The ball check valve thus serves to prevent the outflow of air from the toilet tank through the conduit while air is being drawn from the toilet bowl by the blower 36.

In the preferred embodiment, the blower 36 comprises a centrifugal blower. However, it will be appreciated that other types of blowers could be used.

The outlet 35 of the blower 36 connects to the zapper 38 (FIG. 3). In the preferred embodiment, the zapper comprises a circular electrode 39 and a straight electrode 42, the straight electrode 42 being charged to an electric potential sufficient to create an electrical discharge in the form of a spark between the respective electrodes. The diameter of the grounded electrode is equal to the diameter of the blower's exhaust port and the positive and grounded electrodes are spaced one-half that distance apart.

It has been found that, where the distance between the electrodes 39 and 42 is on the order of ¾ inch, the electric potential necessary to create an electrical discharge between the electrodes is approximately 70,000 volts.

It will be appreciated that either electrode 39 or electrode 42 may be charged and the other electrode grounded in order to produce the desired electrical discharge between such electrodes.

Figure 4:
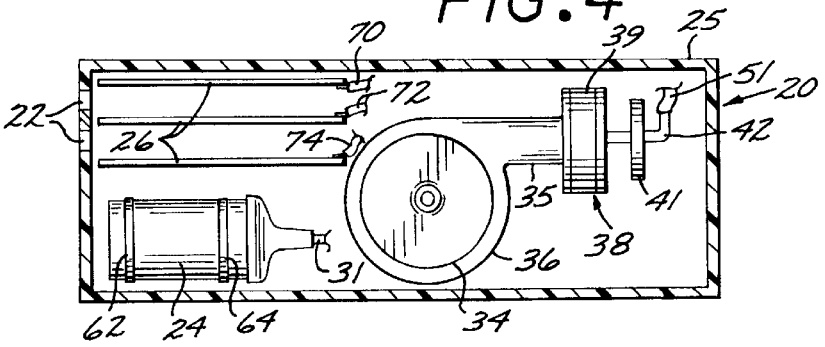
FIG. 4 is a horizontal sectional view taken along the line 4—4 of FIG. 3.

In order to create a spark across a pair of spaced apart electrodes, the spark generator 62 comprising the transformer 24 and pulse generator 44 is included in the present invention. The spark generator receives power from an external power source, generates a preferred pulse rate, and steps up the voltage to the required level. The stepped up series of voltage pulses is then transmitted through a high voltage wire 31 to the positive electrode 42 via a wire 51 and to the plates 26 of the electronic dust precipitator via wires 70, 72 and 74 (FIG. 4) as described in greater detail below.

In applications where the blower has a circular exhaust port, the straight electrode 42 must be disposed at the center of the circular electrode 39. The straight electrode is securely maintained in place positioned at the center of the circular electrode by means of an electrode support 41. The support connects to a base 43 mounted to the bottom of the housing 20 and includes a bore formed in a predetermined position therein for extension therethrough of the electrode 42 to properly align the end of the electrode at the center of the circular electrode 39.

In the preferred embodiment, the electrode 39 assumes a circular configuration (FIG. 5) with the straight electrode 42 disposed at the radial center thereof. It will be appreciated that the electrodes could assume many different forms. For example, the electrodes could both be straight and parallel to each other if the outlet 35 of blower 36 is square or rectangular in cross section.

The housing 20 further houses the air pump 30 therein disposed within the collection dome 28. The air pump includes a gas outlet 33 connected to one end of a tube 32 which extends through a second opening 37 formed in the bottom wall of the housing and which has an open second end disposed in the toilet tank 16. The air pump further includes a gas inlet opening into the collection dome for withdrawing gas from the collection dome and injecting such gas into the toilet tank below the water line. Because the collection dome is elevated relative to the box 25, burnt gases such as the by-products created by the zapper 38 will tend to collect in the dome. Thus, such by-products as, for example, sulphur dioxide, will be pumped through the water in the toilet tank for scrubbing as in a gas absorption process, as described in greater detail below.

Still further housed in the housing 20 and disposed immediately in front of the exhaust ports 22 are the highly electrically charged parallel plates 26 defining the electronic dust precipitator 19 which serve to capture charged particles in the air exiting through the zapper 38 before such air is expelled from the housing through the exhaust ports.

Figure 6:
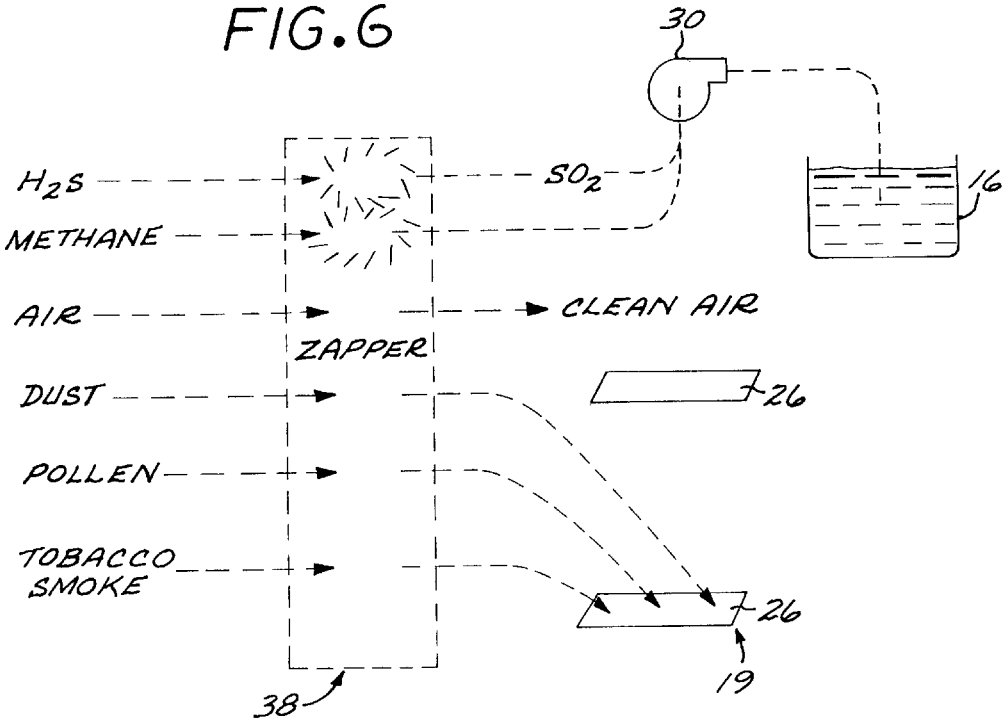
FIG. 6 is a schematic diagram depicting the flow paths of various gases during operation of the air deodorizer system of the present invention.

Referring to FIG. 6, there is shown a schematic diagram of the various gases and particles frequently contained in bathroom air. Hydrogen sulfide, methane, as well as other foul-smelling gases containing hydrocarbons are quite flammable. As such when these compounds pass through the zapper 38 they will be heated to extremely high temperatures on the order of 10,000 degrees Fahrenheit, resulting in the hydrogen sulfide reacting with oxygen molecules to form sulphur dioxide and the methane reacting with oxygen molecules to form carbon dioxide. The hot combustion products will collect in the collection dome 28 for withdrawal therefrom by the air pump 30 to be disposed in the toilet tank 16 through the tube 32.

With further reference to FIG. 6, solid particles such as dust and pollen as well as tobacco smoke contained in the gas withdrawn from the toilet bowl 46 will pass through the zapper 38 and will be ionized by the zapper. Thus, as such charged particles travel toward the exhaust ports 22, the plates 26 of the electronic dust precipitator will serve to attract and capture such charged particles thereon. Thus, it will be appreciated that the gas exiting through the exhaust ports will comprise substantially clean air.

Figure 7:
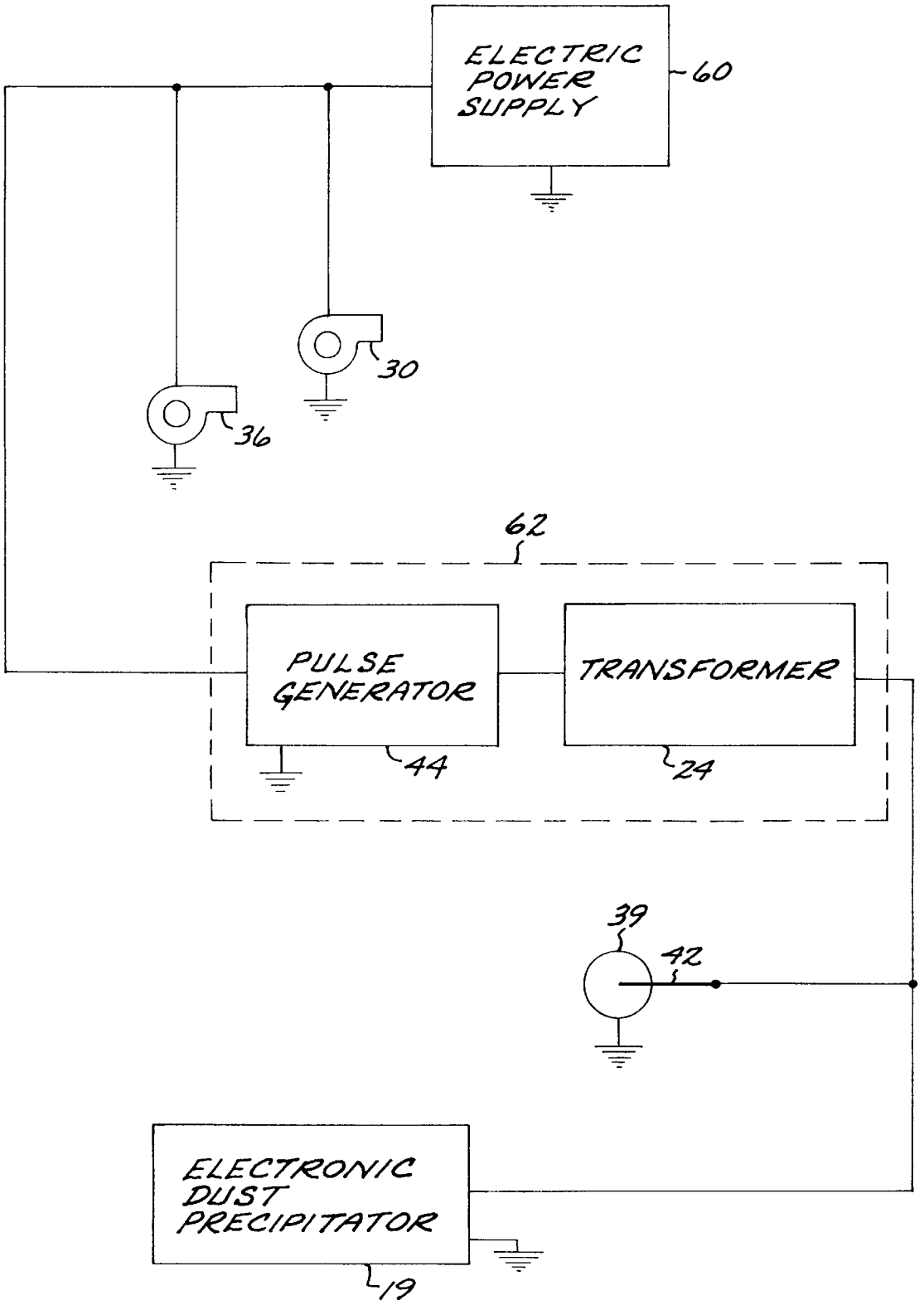
FIG. 7 is an electrical schematic of the control system incorporated in the air deodorizer system shown in FIG. 1.

Referring to FIG. 7, there is shown a schematic diagram depicting the electrical connections of the electrical components included in the present invention. An electrical power supply 60 is provided for connection in parallel with the air pump 30, the blower 36, and the input of the spark generator 62. In the preferred embodiment the electrical power supply 60 comprises an electrical cord including a plug for plugging into a standard electrical outlet to supply electric power to the air pump, the motor of the blower and to the spark generator.

In the preferred embodiment, the pulse generator 44 of the spark generator 62 receives the relatively low voltage input from the electrical power supply 60 and outputs a series of voltage pulses. The transformer 24 receives the output from the pulse generator 44 at a preferred pulse rate and outputs to the zapper 38 a series of high voltage pulses which serve to create a continuous series of sparks between the electrodes 39 and 42 of the zapper 38 to burn the odorous gases passing between those electrodes. The output of the transformer also connects in parallel to the precipitator plates 26 of the electronic dust precipitator to charge such plates.

In use, the air deodorizer system 10 of the present invention may conveniently take the place of a conventional toilet tank lid to be disposed in an out of the way manner for efficient use thereof. With the gas conduit 21 extending through the toilet tank 16 and connected with the gas outlet 48 of the toilet bowl 46 and the scrubber tube 32 disposed in the toilet tank, the electronic air deodorizing system of the present invention is ready for use.

When a user uses the toilet and the system is activated, the motor 34 is energized to actuate the blower 36. Actuation of the blower serves to withdraw the air in the toilet bowl 46 through the air outlet 48 and air conduit 21 to the inlet of the blower. The blower acts to expel such air through the outlet 35 of the blower and past the zapper 38. The zapper is activated to create a series of electrical sparks which, due to the lower disruptive strength of oxygen atoms relative to nitrogen atoms, will be attracted to the oxygen molecules and will pass therethrough. This will cause the oxygen molecules to be heated to temperatures on the order of several thousand degrees Fahrenheit, which is substantially higher than the ignition temperatures of the flammable hydrocarbons and hydrogen sulfide typically found in bathroom air. As such, the flammable hydrocarbons and hydrogen sulfide located in close proximity to the heated oxygen molecules will be ignited and burned, so that the hydrogen sulfide will react with the oxygen to form water and sulphur dioxide while methane will react with oxygen to form water and carbon dioxide. These products of combustion will have relatively high temperatures as they pass out of the zapper.

In addition, the electrical discharge serves to seek out and incinerate any air-borne bacteria or virus passing between the electrodes, thereby performing yet another beneficial function in addition to burning any odorous, flammable gases.

As the gas exits through the zapper 38, it enters the housing 20. Aside from the exhaust ports 22, the housing is air tight. As such, the gas being discharged from the zapper may only exit the housing via the exhaust ports 22 and will thus be drawn toward such ports. As the gas flows thereto-ward it will pass beneath the collection dome 28. The heated by-products of the combustion process, such as sulphur dioxide and carbon dioxide, will rise up into the collection dome where the air pump 30 will serve to withdraw such by-products from the dome and pump same through the scrubber tube 32 and into the water of the toilet tank. The sulphur dioxide is absorbed by the toilet tank water and will be disposed of when the toilet is flushed.

The zapper 38 also serves to ionize solid particles carried in the air which passes through the zapper, such as dust and pollen, as well as ionizing particles in tobacco smoke which may be found in such air. As such, as the charged particles are flowed toward the exhaust ports 22, the highly charged electrostatic plates 26 attract and collect such particles.

Thus, it will be appreciated that the air exiting the housing 20 through the exhaust ports 22 will comprise substantially clean air, as the heated by-products of the combustion process will be pumped from the collection dome into the water tank while the electrically charged particles in the gas will be captured by the electrostatic plates.

The electronic air deodorizer 10 of the present invention may be conveniently used in many different locations. One of the most applicable uses of the deodorizer is in connection with a toilet, which will often be the site of substantial quantities of noxious gases. Thus, the deodorizer is shown in the figures with the air conduit 21 extending from the housing 20 for connection with a conventional toilet. However, it will be appreciated that the deodorizer of the present invention could be formed with a portable housing for placement in any desired location to efficiently burn odorous gases and to electrically charge and capture dust, pollen, tobacco smoke and the like, as well as incinerating air-borne bacteria and viruses. In such an embodiment, the apparatus would not include the air conduit 21 extending from the housing, the air pump 30 or the tube 32 extending from the housing. Such an apparatus could be placed in any desired location, such as on a kitchen counter, a table, or in any relatively enclosed location to efficiently deodorize the air in that location. As such, the use of the present invention in connection with a toilet is meant to illustrate one efficient use of the present invention, and is in no way meant to limit the present invention to that specific application.

From the foregoing, it will be appreciated that the electronic air deodorizing system of the present invention serves to eliminate noxious gases in an energy efficient manner. The present invention further serves as an air cleaner to remove solid particles from the air before emission in an enclosed space.

While a particular form of the present invention has been illustrated and described, it will also be apparent that various modifications can be made without departing from the spirit and scope of the invention. Accordingly, it is not intended that the invention be limited, except as by the appended claims.

What is claimed is:

1. A deodorizer system for treating odorous flammable gases from a toilet stool having an air outlet and comprising:

an air conduit for connection with said air outlet and defining a flow path;

a pair of spaced apart electrodes disposed in said flow path;

a spark generator connected with one of said electrodes for applying an electrical charge to said electrode to produce an electrical discharge between said electrodes to burn at least a portion of said odorous gases to nonodorous byproducts;

a blower for drawing said air through said air conduit and directing said air along said flow path past said electrodes; and an electronic dust precipitator disposed downstream of said electrodes and electrically charged to collect charged particles.

2. The system of claim 1 wherein said toilet stool includes a water tank, said system further including:

a collection dome downstream of said electrodes for collecting gases burnt by said electrodes;

a tube leading from said dome and including an open distal end to be submerged in water in said water tank; and an air pump interposed between said collection dome and said tube for blowing said gases from said dome through said tube and out said open distal end of said tube.

3. The system of claim 1 wherein said toilet stool includes a water tank, wherein:

said air conduit includes a side port connected to a check valve formed with a water overflow inlet disposed in said tank.

4. An apparatus for removing and treating odorous gases from a toilet stool having an air outlet and comprising:

a housing including an opening formed on one end thereof;

an air conduit formed with an internal air chamber and including an upstream first end adapted to be connected to said air outlet and an open downstream second end extending through said opening and into said housing;

a pair of spaced apart highly charged electrodes disposed in said air chamber to produce an electrical discharge in the form of a spark arcing between the respective said electrodes to burn said gases;

a blower housed in said housing and connected to said air conduit for drawing air through said upstream first end and past said electrodes; and an electronic dust precipitator in said housing for capturing charged particles created by said sparks arcing between said electrodes.

5. The apparatus of claim 4 wherein said toilet stool includes a water tank, said apparatus further including:

a collection dome connected to said housing and elevated relative to said housing for collecting heated gases therein; and an air pump including an inlet disposed in said dome and an outlet connected to one end of a tube including a second end disposed in said water tank for evacuating burnt gases in said collection dome and discharging said gases into said water tank.

6. The apparatus of claim 4 wherein:

said housing includes at least one exhaust port formed therein for allowing the escape of air from said housing and wherein:

said electronic dust precipitator is disposed adjacent said exhaust port and comprises a plurality of spaced apart electrically charged plates.

7. The apparatus of claim 4 wherein said toilet stool includes a water tank, wherein:

said gas conduit includes a side port and further including:

a check valve connected with said port and formed with a water overflow inlet.

* * * * *